US009861186B2

(12) United States Patent
Kurani

(10) Patent No.: US 9,861,186 B2
(45) Date of Patent: Jan. 9, 2018

(54) ADAPTABLE BRUSH

(71) Applicant: Hemant Chandrakant Kurani, Riverside, CA (US)

(72) Inventor: Hemant Chandrakant Kurani, Riverside, CA (US)

( * ) Notice: Subject to any disclaimer, the term of this patent is extended or adjusted under 35 U.S.C. 154(b) by 197 days.

(21) Appl. No.: 14/808,732

(22) Filed: Jul. 24, 2015

(65) Prior Publication Data

US 2016/0022021 A1 Jan. 28, 2016

Related U.S. Application Data

(60) Provisional application No. 62/029,248, filed on Jul. 25, 2014.

(51) Int. Cl.
*A46B 5/00* (2006.01)
*A46B 7/02* (2006.01)

(52) U.S. Cl.
CPC ..... *A46B 5/0054* (2013.01); *A46B 5/0058* (2013.01); *A46B 7/02* (2013.01); *A46B 2200/302* (2013.01)

(58) Field of Classification Search
CPC ..... A46B 5/0054; A46B 5/0058; A46B 7/02; A46B 2200/302; A47L 13/258; A47L 13/20
See application file for complete search history.

(56) References Cited

U.S. PATENT DOCUMENTS 4,845,800 A * 7/1989 Pederson ..... A47L 13/258 15/147.1
8,485,751 B2 * 7/2013 Vetesnik ..... F16B 7/105 403/109.1

* cited by examiner

*Primary Examiner* — Shay Karls
(74) *Attorney, Agent, or Firm* — Snell & Wilmer L.L.P.

(57) ABSTRACT

A brush includes a middle piece having a left connector and a right connector, and a left piece including a left middle portion having a proximate end, a hinge end, and a connector coupled to the proximate end and configured to be removably coupled to the left connector of the middle piece. The left piece also includes and a left end portion having a distal end and a hinge end pivotably coupled to the hinge end of the left middle portion. The brush also includes a right piece including a right middle portion having a proximate end, a hinge end, and a connector coupled to the proximate end and configured to be removably coupled to the right connector of the middle piece. The right piece also includes a right end portion having a distal end and a hinge end pivotably coupled to the hinge end of the right middle portion.

9 Claims, 12 Drawing Sheets

ADAPTABLE BRUSH

CROSS REFERENCE TO RELATED APPLICATIONS

This application claims the benefit and priority of U.S. Provisional Application No. 62/029,248, entitled "Adaptable Brush," filed on Jul. 25, 2014, the entire contents of which are hereby incorporated by reference herein.

BACKGROUND

Field

The present disclosure relates to an adaptable brush having various pieces removably coupled together and each having a length that is less than a length of the adaptable brush.

Description of the Related Art

Brushes have been around for a long time. A traditional brush has a length and a width, bristles on an underside, and a pole attached to the brush. The brush may be placed on a surface such that the bristles are in contact with the surface and "brushing" may occur when the brush is moved across the surface, causing the bristles to move any debris on the surface.

Many brushes have been designed for many purposes, such as for brushing pool decks, for brushing a floor of a home, and for polishing shoes. Some of these brushes are relatively small in size, such as the shoe brush, and some can be relatively large, such as the pool deck brush. The pool deck brush is traditionally one of the larger brushes because large pool decks can be brushed with relative ease if the pool deck brush is sufficiently large.

Due to the large size of the pool deck brushes, they may incur significant shipping cost as compared to smaller items. This is especially undesirable in the current digital age because many consumers purchase their goods online and have the goods shipped directly to their house. The additional shipping cost must be paid by at least one of the consumer or the distributor, either decreasing appeal of the purchase to the consumer or increasing distribution costs of the distributor.

Thus, it is desirable to have a brush that can be used to brush a relatively large area while having a lower shipping cost than traditional brushes.

SUMMARY

Described herein is a brush that includes a middle piece having a left side and a right side and including a pole connector adapted to connect to a pole. The middle piece also includes a left connector positioned on the left side of the middle piece, and a right connector positioned on the right side of the middle piece. The brush also includes a combined left piece including a left middle portion having a proximate end, a hinge end, and a connector coupled to the proximate end and configured to be removably coupled to the left connector of the middle piece. The combined left piece also includes and a left end portion having a distal end and a hinge end pivotably coupled to the hinge end of the left middle portion. The brush also includes a combined right piece including a right middle portion having a proximate end, a hinge end, and a connector coupled to the proximate end and configured to be removably coupled to the right connector of the middle piece. The combined right piece also includes a right end portion having a distal end and a hinge end pivotably coupled to the hinge end of the right middle portion.

Also described is a brush that includes a middle piece having a left side and a right side and including a pole connector adapted to connect to a pole, a left connector positioned on the left side of the middle piece, and a right connector positioned on the right side of the middle piece. The brush also includes a left end piece having a left side and a right side and including a cap positioned on the left side of the left end piece. The left end piece also includes a proximate connector positioned on the right side of the left end piece that is configured to connect to the left connector of the middle piece. The brush also includes a right end piece having a left side and a right side and including a cap positioned on the right side of the right end piece. The right end piece also includes a proximate connector positioned on the left side of the right end piece that is configured to connect to the right connector of the middle piece.

Also described is a brush having a middle piece having a left side and a right side and including a left connector positioned on the left side of the middle piece and a right connector positioned on the right side of the middle piece. The brush also includes a left side piece having a left side and a right side and including a distal connector and a proximate connector positioned on the right side of the left side piece and configured to connect to the left connector of the middle piece. The brush also includes a right side piece having a left side and a right side and including a distal connector and a proximate connector positioned on the left side of the right side piece and configured to connect to the right connector of the middle piece. The brush also includes a left end piece having a right side and a left side and including a proximate connector positioned on the right side of the left end piece and configured to connect to the distal connector of the left side piece. The brush also includes a right end piece having a right side and a left side and including a proximate connector positioned on the left side of the right end piece and configured to connect to the distal connector of the right side piece.

BRIEF DESCRIPTION OF THE DRAWINGS

Other systems, methods, features, and advantages of the present invention will be or will become apparent to one of ordinary skill in the art upon examination of the following figures and detailed description. It is intended that all such additional systems, methods, features, and advantages be included within this description, be within the scope of the present invention, and be protected by the accompanying claims. Component parts shown in the drawings are not necessarily to scale, and may be exaggerated to better illustrate the important features of the present invention. In the drawings, like reference numerals designate like parts throughout the different views, wherein:

DETAILED DESCRIPTION

Figure 1A:
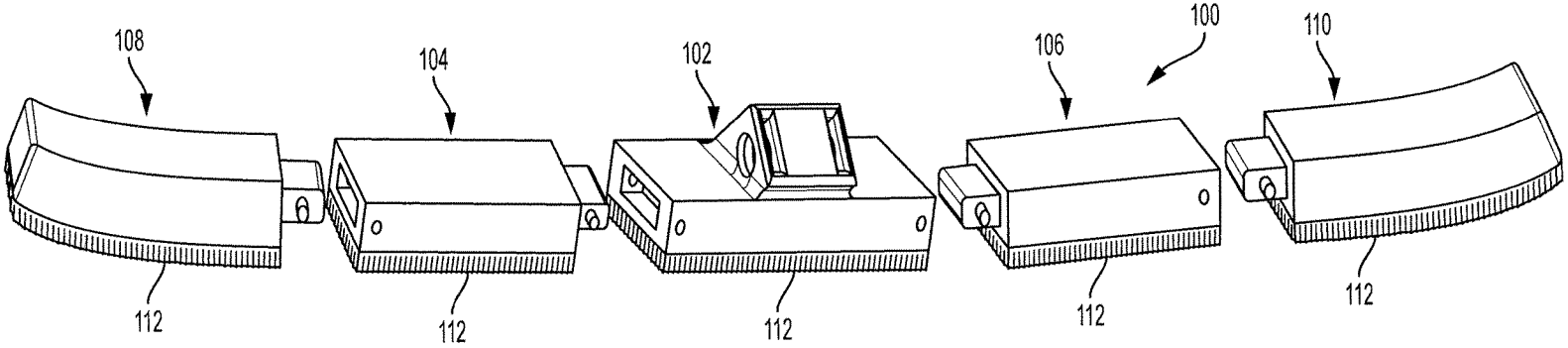
FIG. 1A is an exploded view of an adaptable brush according to an embodiment of the invention.

FIG. 1A illustrates a modular brush (brush) 100. The brush 100 may include a middle piece 102, a left side piece 104, a right side piece 106, a left end piece 108, and a right end piece 110. The terms left and right are used herein for ease of reference, however, one skilled in the art will realize that the terms left and right can be swapped without changing the scope of the invention.

Each of the pieces 102, 104, 106, 108, 110 can have a rectangular prism shape, however, in some embodiments, some or all of the pieces 102, 104, 106, 108, 110 can have a different shape. Furthermore, the pieces 102, 104, 106, 108, 110 can be solid, hollow, or partially hollow and can include rubber, plastic, metal, wood, or any combination thereof.

In FIG. 1A, each of the pieces 102, 104, 106, 108, 110 include bristles 112 (i.e., a plurality of relatively narrow and stiff filaments). The bristles 112 can include polyester, nylon, metal (for example, stainless steel), natural fiber material (such as from wood, plants or animal hair), or any combination thereof.

Various sets of pieces can be provided having different types of bristles. For example, the set of pieces 102, 104, 106, 108, 110 can include metal bristles and another set of pieces can include polyester bristles. In some embodiments, a set of pieces can include combinations of bristles, such that each piece can include, for example, a combination of metal and polyester bristles. This allows for various brushes to be provided, each being particularly effective on one or more surfaces. For example, metal bristles may be particularly effective on concrete and polyester bristles may be particularly effective on brick.

In some embodiments, the brush 100 can include multiple left side pieces and multiple right side pieces. In some embodiments, the brush 100 may not include side pieces 104, 106 and in some embodiments, the brush 100 may not include end pieces 108, 110. In that regard, the brush 100 can include the middle piece 102 only, the middle piece and one or both of the left end piece 108 and the right end piece 110, or the middle piece 102 and one or both of the left side piece 104 and the right side piece 106.

Figure 1B:
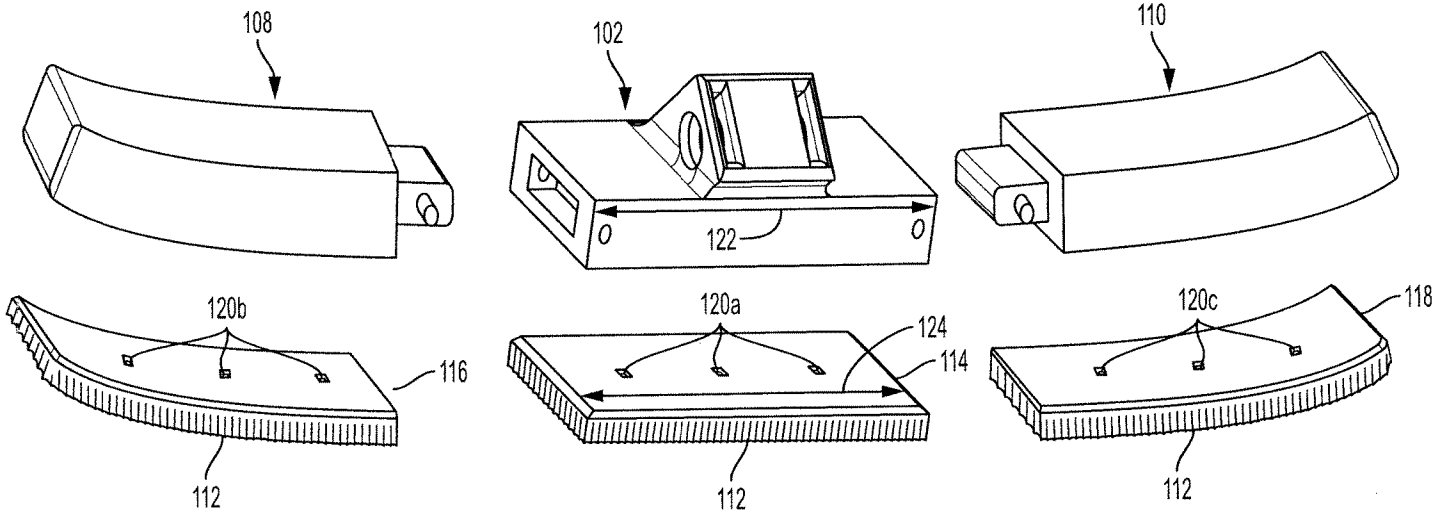
FIG. 1B is an exploded view an adaptable brush without attached side pieces according to an embodiment of the invention.

FIG. 1B illustrates an exploded view of an embodiment of the brush 100 having no side pieces. In FIG. 1B, the brush 100 includes the middle piece 102, the left end piece 108 and the right end piece 110.

The embodiment illustrated in FIG. 1B is notable in that that the bristles 112 are not integral to the pieces 102, 108, 110. Instead, the pieces 102, 108, 110 each have one or more connectors (such as a bristle connector 400 shown in FIG. 4) adapted to connect each piece 102, 108, 110 to a respective bristle attachment. For example, the middle piece 102 has a bristle connector (400 in FIG. 4) adapted to connect the middle piece 102 to a connector 120*a* of a center bristle attachment 114. The left end piece 108 has a connector (not shown) adapted to connect the left end piece 108 to a connectors 120*b* of a left end bristle attachment 116. The right end piece 110 has a connector (not shown) adapted to connect the right end piece 110 to a connector 120*c* of a right end bristle attachment 118. The connectors may be snap connectors, including but not limited to those illustrated in FIGS. 10A-10B, spring clips, buttons, screw threading, or the like.

The bristle attachments 114, 116, 118 or any other bristle attachment may have a same length as the piece 102, 108, 110 for which it is to connect. For example, the center bristle attachment 114 may have a length 124 that is the same as a length 122 (i.e., a length of a longitudinal axis) of the middle piece 102. In some embodiments, bristle attachments may be provided having larger lengths than any one of the pieces 102, 104, 106, 108, 110 alone. For example, a longer bristle attachment (not shown) may be provided that has a length equal to the sum of the lengths of the middle piece 102, the left end piece 108 and the right end piece 110. In these embodiments, the longer bristle attachment may have connectors for connecting to the connectors of each of the middle piece 102, the left end piece 108, and the right end piece 110 such that the bristle attachment spans the entire brush. The removability of the bristles 112 allows for multiple sets of bristles, each having a different type of bristles, to be provided.

In the embodiment illustrated in FIG. 1B, no left side pieces or right side pieces are illustrated. However, in similar embodiments including side pieces, the side pieces can include connectors for connecting to bristle attachments.

Figure 2:
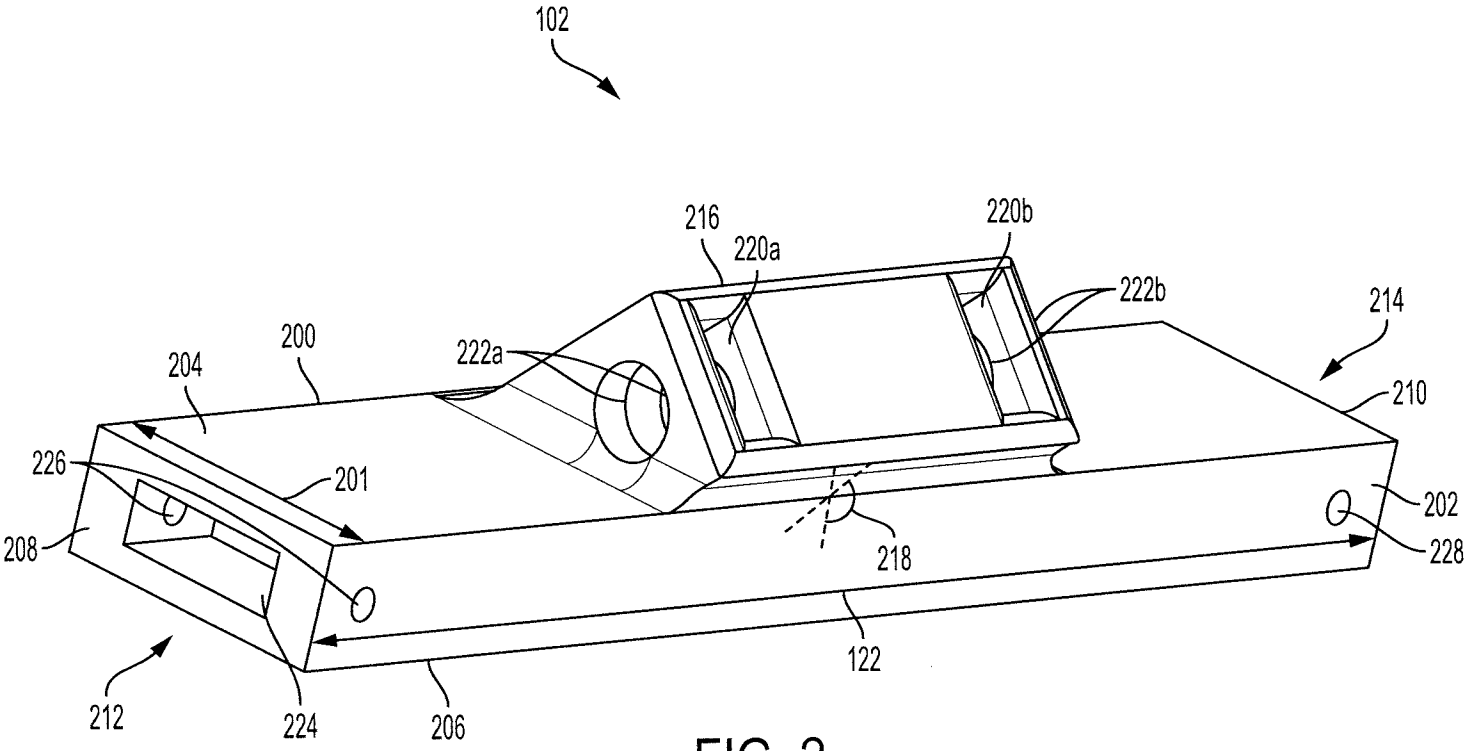
FIG. 2 is an enlarged view of a middle piece according to an embodiment of the invention.

FIG. 2 is an enlarged perspective view of the middle piece 102. As illustrated, the middle piece 102 has a front 200, a back 202, a top 204, a bottom 206, a left side 208 and a right side 210. The middle piece 102 also includes a pole connector 216, a left connector 212, and a right connector 214. The front 200 is the direction of movement of the brush 100 when a user pushes the brush 100 forward. However, in some embodiments, the brush 100 may also or instead be configured to move towards the back 202, the left side 208, and/or the right side 210.

The middle piece may have a width 201 of any distance. In preferred embodiments, the width 201 is between 1 inch (2.54 cm) and 10 inches (25.4 cm). The length 122 of the middle piece 102 may have any distance. In preferred embodiments, the length 203 is between 4 inches (10.16 cm) and 10 inches (25.4 cm).

The pole connector 216 may be positioned on the top 204 of the middle piece 102 and/or on the back 202 of the middle piece 102. The pole connector 216 may be used to connect the middle piece 102 to a pole unit (such as the pole unit 250 of FIG. 2B). The pole connector 216 may include a snap connector, including but not limited to those illustrated in FIGS. 10A-10B, a spring clip, a button, a pin, screw threading or the like. In some embodiments, the middle piece 102 does not include a pole connector 216 and instead is directly connected to the pole.

In some embodiments, the pole connector 216 may be adapted to connect the middle piece 102 to the pole unit at an angle 218 from the back 202 of the middle piece 102. The angle 218 may be, for example, any angle between 0 degrees and 180 degrees. In some embodiments, the pole connector 216 may include a feature allowing the angle 218 to be adjustable within a range, such as between 0 degrees and 180 degrees. In some embodiments, the pole connector 216 may be adapted to allow the pole to swivel within a range. For example, the pole could move towards the front 200, the back 202, the left 208 and/or the right 210 of the middle piece 102 up to a predetermined angle from its base position. As shown in FIG. 2, the angle 218 is fixed at 45 degrees.

In the illustrated embodiment, the pole connector 216 is rectangular in shape and extends upwards from the top 204 of the middle piece 102 and towards the back 202 of the middle piece 102. The pole connector 216 defines a rectangular left opening 220*a* and a rectangular right opening 220*b*, each orthogonal to the longitudinal axis of the middle piece 102. The pole connector 216 also defines a pair of apertures 222 perpendicular to and positioned on either side of the rectangular openings 220. In some embodiments and as shown, the apertures 222 may be rounded.

Figure 3:
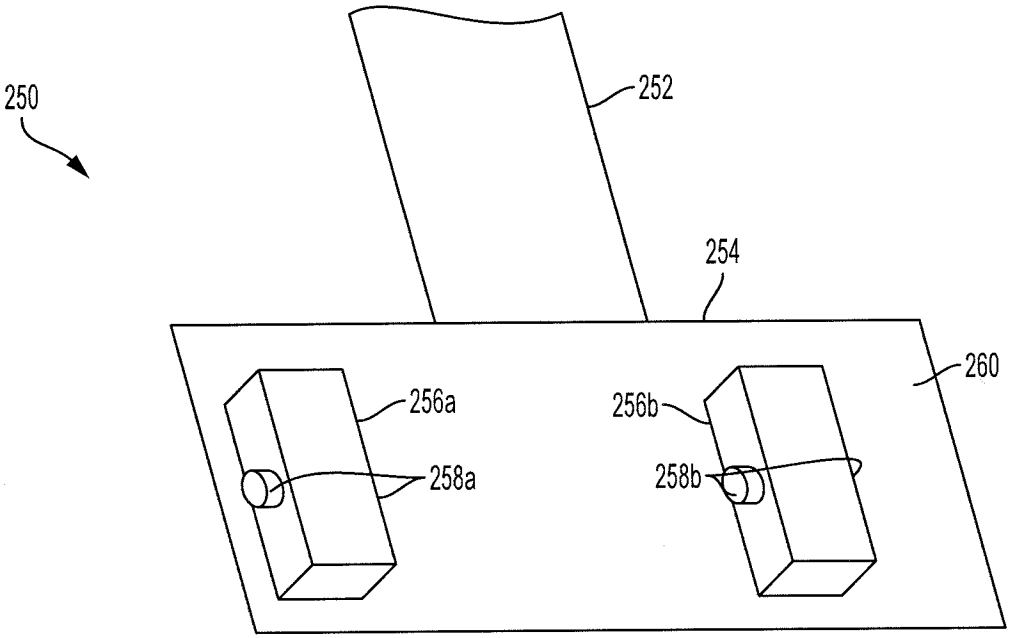
FIG. 3 is a bottom view of a pole unit for connecting to the middle piece of FIG. 2 according to an embodiment of the invention.

FIG. 3 illustrates a bottom view of the pole unit 250. With reference to FIGS. 2 and 3, the pole unit 250 includes a pole 252 and a connector 254 configured to connect to the pole connector 216 of the middle piece 102. The connector 254 includes a first rectangular member 256*a* having a pair of rounded protrusions 258*a* extending therefrom, and a second rectangular member 256*b* having a pair of rounded protrusions 258*b* extending therefrom. In some embodiments, the rectangular members 256 can have any other shape. The pairs of rounded protrusions 258 may be coupled to the members 256 via compression springs (not shown) that force the rounded protrusions 258 away from the members 256.

When the pole unit is to be connected to the middle piece 102, each of the members 256 is aligned with a corresponding one of the rectangular openings 220 and force may be applied to push the members 256 into the rectangular openings 220. This force, or a manual force, can compress the springs such that the rounded protrusions 258 move inward towards the corresponding members 256. When the members 256 are in place within the rectangular openings 220 (i.e., each of the rounded protrusions 258*a* is each aligned with one of the pair of apertures 222), the springs force the rounded protrusions 258 to extend into the apertures 222, causing the pole unit 250 to remain in place relative to the middle piece 102.

In order to de-couple the pole unit 250 from the middle piece 102, the rounded protrusions 258 may be pushed inward towards a center of the members 256 at the same time that force is applied to separate the pole unit 250 from the middle piece 102. When the springs are sufficiently compressed, the rounded protrusions 258 are no longer positioned within the pairs of apertures 222 and the members 256 can be removed from the rectangular openings 220.

In some embodiments, the rounded protrusions 258 of the pole unit 250 may instead be holes. In these embodiments, a pin, such as a split pin or a coupling pin and retainer (not shown), may be inserted through the holes. The pin may have, for example, a flat surface having a larger diameter than the pin and perpendicular to the pin at a first end of the pin and a bulbous protrusion on a second end of the pin, or an aperture on the second of the pin for receiving a retainer.

The bulbous protrusion may be pushed through the apertures 222 and the holes of the pole unit 250. The flat surface may become flush with the outside of the pole connector 216 on a first side having the holes 222*a* and the bulbous protrusion may press against the outside of the first connector on a second side having the holes 222*b*. As the bulbous protrusion is larger than the apertures 222, the pin will not be removed until a user forces the bulbous protrusion back through the apertures 222.

The pole 252 may have any shape. For example, it can be a solid pole or a hollow tube. The outer surface of the pole 252 can be rounded (such that a cross-sectional view would appear circular, oval or the like) or it can be angled (such that a cross-sectional view would appear square, rectangular or the like).

The pole 252 may be telescoping, such that its length is adaptable. It also may be provided in separate pieces that are each adapted to connect to each other via a connection such as a snap connector, including but not limited to those illustrated in FIGS. 10A-10B, a spring clip, a button, a pin, screw threading or the like.

In some embodiments, the pole connector 216 is to be connected to a handle adapter (not shown) instead of the pole 252. For example, the pole 252 may be removably coupled to the connector 254 instead of integral to the connector 254, such that the handle adapter would comprise the connector 254 without the pole 252. In these embodiments, the handle adapter would be configured to removably connect to the pole 252. For example, the pole may connect to the handle adapter via a snap connector, including but not limited to those illustrated in FIGS. 10A-10B, a spring clip, a button, a pin, screw threading or the like.

Figure 4:
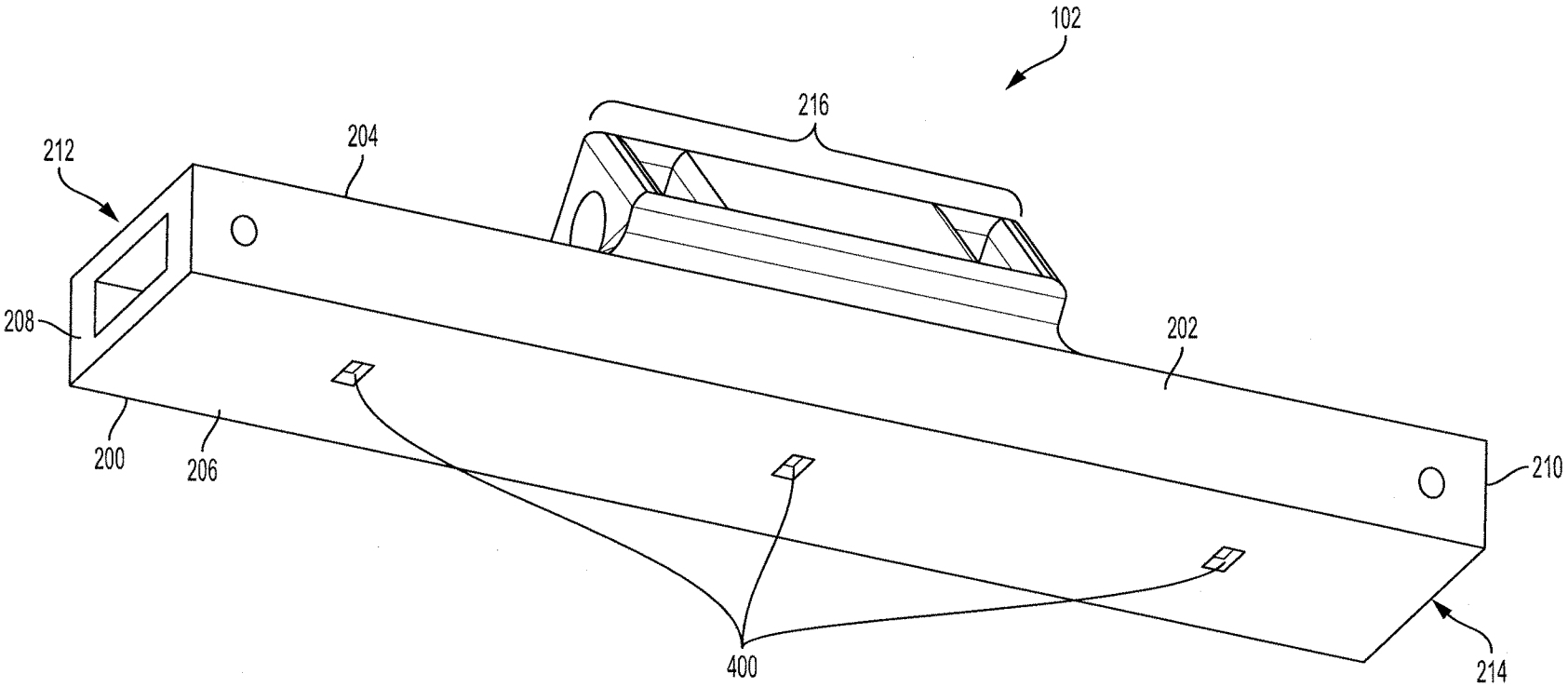
FIG. 4 is a bottom view of the middle piece of FIG. 2 according to an embodiment of the invention.

FIG. 4 illustrates the bottom 204 of the middle piece 102 having the bristle connector 400. In FIG. 3, the bottom 206 of the middle piece 102 includes the bristle connector 400 that is adapted to connect the center bristle attachment 114 to the bottom 206 of the middle piece 102. The bristle connector 400 may be a snap connector, including but not limited to those illustrated in FIGS. 10A-10B, a spring clip, a button, a pin, screw threading or the like.

In some embodiments and with reference to FIGS. 1A and 4, the front 200 and the back 202 of the middle piece 102 may include a connector (not shown) adapted to connect the middle piece 102 to the center bristle attachment 114. For example, this connector may include straps that connect to the front 200 and/or the back 202 of the middle piece 102 and wrap around the center bristle attachment 114. In some embodiments, the left side 208 and the right side 210 of the middle piece 102 may include a connector (not shown) adapted to connect the middle piece 102 to the center bristle attachment 114. Accordingly, the center bristle attachment 114 can connect to the middle piece 102 in any manner. Any other piece 104, 106, 108, 110 may be adapted to connect to a bristle attachment in the same fashion as the middle piece 102.

Figure 10A:
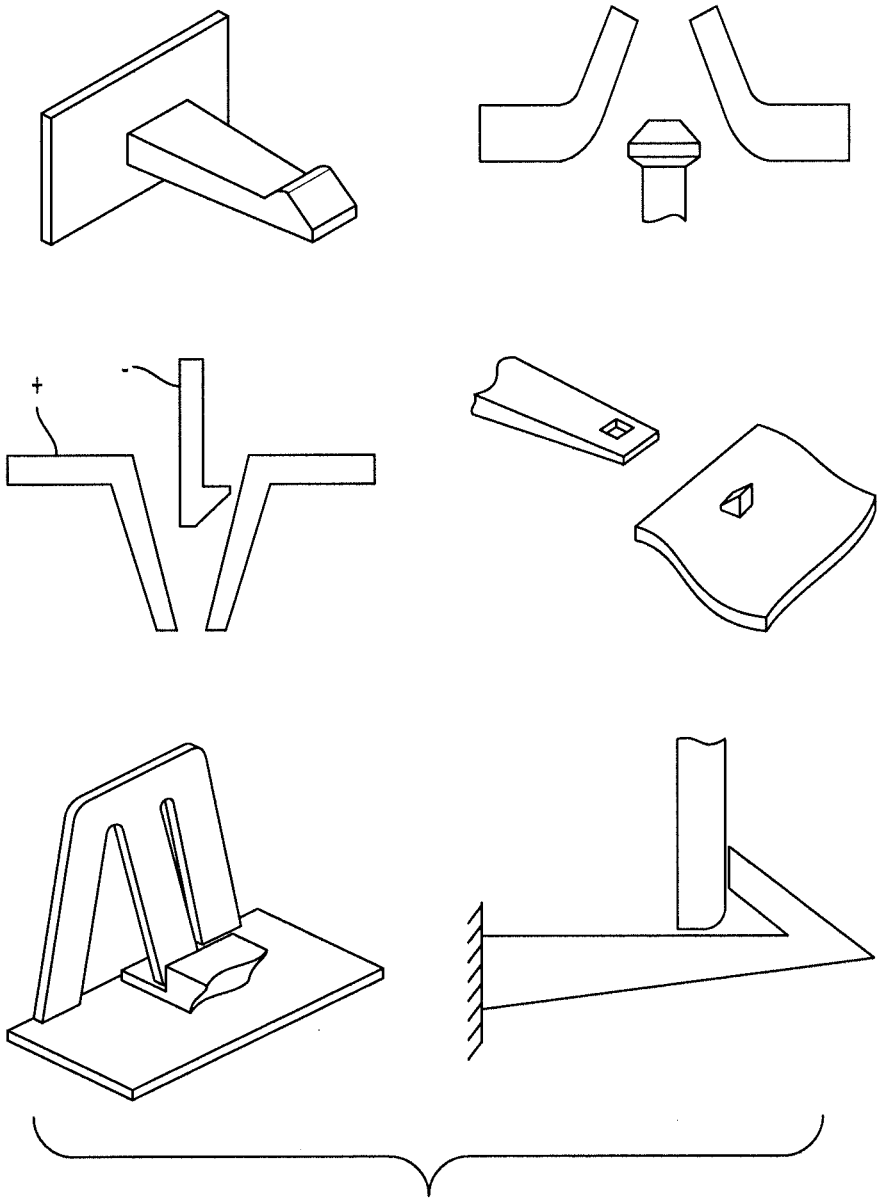
FIGS. 10A-10C illustrate exemplary snap connectors and features thereof according to various embodiments of the invention.
Figure 10C:
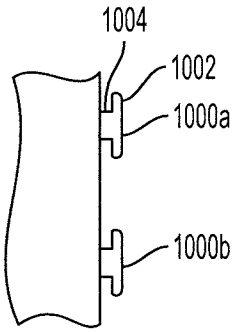
Figure 10B:
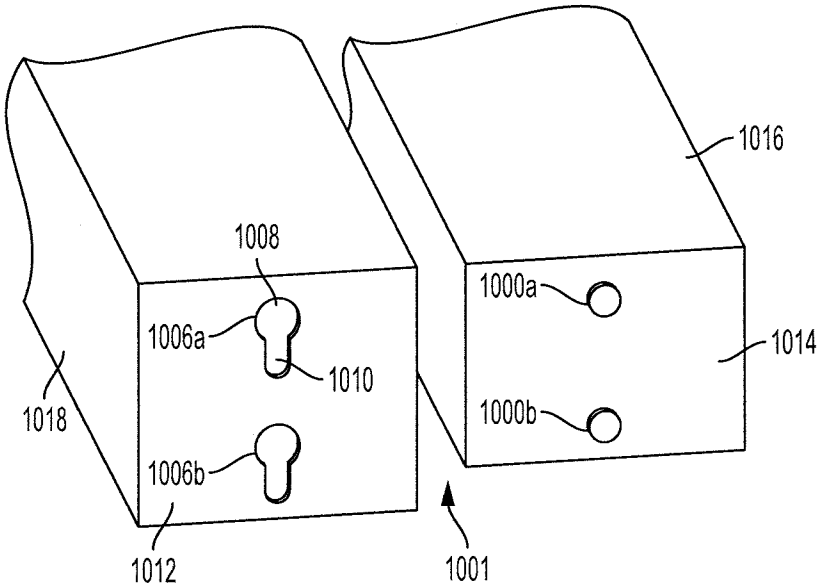

Returning to FIG. 2, the left connector 212 may be a snap connector, including but not limited to those illustrated in FIGS. 10A-10B, a spring clip, a button, a pin, screw threading or the like. The left connector 212 may be positioned on the left side 208 of the middle piece 102 and may be adapted to connect the middle piece 102 to the left side piece 104 of FIG. 1. In some embodiments, the left connector 212 includes a rectangular opening 224 defined by the middle piece 102. A pair of holes 226 are defined, one between the front side 200 and the rectangular opening 224 and one between the back side 202 and the rectangular opening 224.

The right connector 214 may be a snap connector, including but not limited to those illustrated in FIGS. 10A-10B, a spring clip, a button, a pin, screw threading or the like. The right connector 214 is positioned on the right side 210 of the middle piece 102 and may be adapted to connect the middle piece 102 to the right side piece 106. In some embodiments, the right connector 214 includes a rectangular opening (not shown) similar to the rectangular opening 224 of the left connector 212. The opening includes a pair of holes 228 similar to the pair of holes 226 of the left connector 212.

Figure 5:
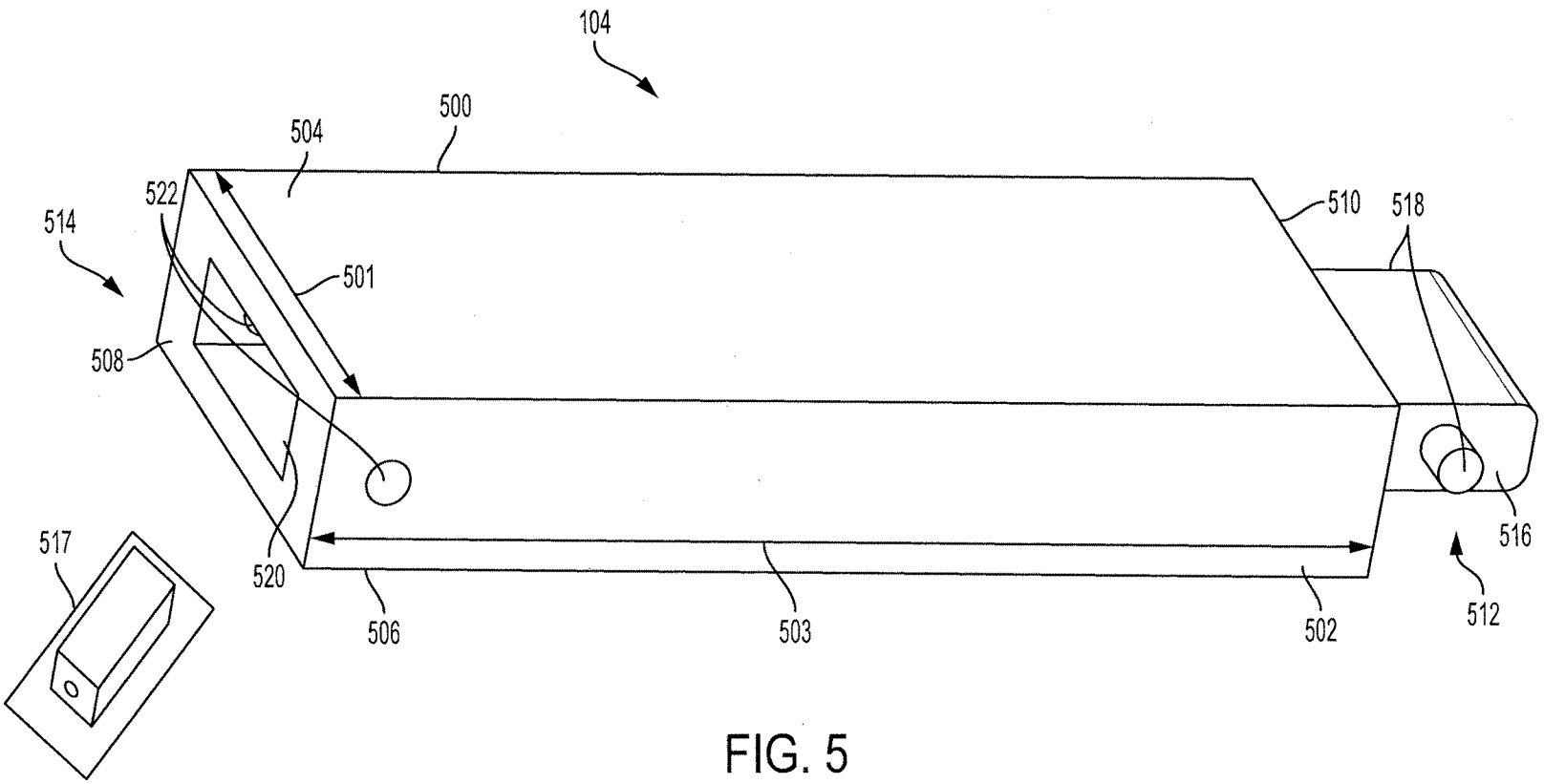
FIG. 5 illustrates a left side piece according to an embodiment of the invention.

FIG. 5 illustrates a perspective view of the left side piece 104. As shown, the left side piece 104 has a front 500, a back 502, a top 504, a bottom 506, a left side 508, and a right side 510. The left side piece 104 also includes a proximate connector 512 (i.e., proximate to the middle piece 102 of FIG. 1) on the right side 510 and a distal connector 514 on the left side 508.

The left side piece 104 may have a width 501 of any distance. In preferred embodiments, the width 501 is between 1 inch and 10 inches. The left side piece 104 may have a length 503 of any distance. In preferred embodiments, the length 503 is between 4 inches and 10 inches.

The proximate connector 512 may be a snap connector, including but not limited to those illustrated in FIGS. 10A-10B, a spring clip, a button, a pin, screw threading or the like. As shown in FIG. 5, the proximate connector 512 includes a rectangular member 516 extending from the left side piece 104 and having a rounded protrusion 518 on either side. The rounded protrusion 518 may be coupled to the rectangular member 516 by a compression spring (not shown) such that the spring forces the rounded protrusion 518 away from the rectangular member 516. In some embodiments, the rectangular member 516 can have any other shape, such as spherical, rectangular prism or the like. In some embodiments, the rounded protrusions 518 can have any other shape, such as triangular, rectangular or the like.

With brief reference to FIGS. 2 and 5, in order to connect the proximate connector 512 of the left side piece 104 to the left connector 212 of the middle piece 102, the rectangular member 516 can be aligned with the rectangular opening 224. The rectangular member 516 can then be pressed into the rectangular opening 224 such that force against the rounded protrusions 518 (such as from the middle piece 102) compresses the springs and moves them towards the center of the rectangular member 516. As the rounded protrusions 518 are aligned with the holes 226, the springs may force the rounded protrusions 518 outward such that they are received by the holes 226, coupling the left side piece 104 to the middle piece 102. In order to remove the left side piece 104 from the middle piece 102, the left side piece 104 can be forced away from the middle piece 102, causing the rounded protrusions 518 to compress the springs such that they are no longer received by the holes 226. In some embodiments, an inward force must be applied to the rounded protrusions 518, such as by a human, in order to couple and/or de-couple the left side piece 104 and the middle piece 102.

In some embodiments, the round protrusions 518 may be holes instead of protrusions and a pin, such as a spring pin or a split pin, may be inserted through the holes. The pin may have, for example, a flat surface having a larger diameter than the pin at a first end of the pin and a bulbous protrusion (or an aperture for receiving a retainer) on a second end of the pin. The bulbous protrusion (or end with the aperture) may go through the holes and the rectangular opening 224. The flat surface may become flush with the back 202 of the middle piece 102. The bulbous protrusion may press against the front 200 of the middle piece 102. The bulbous protrusion may extend any amount from the front 200 of the middle piece 102. In preferred embodiments, the bulbous protrusion only extends 5 millimeters or less from the front 200 of the middle piece 102. This small extension distance ensures that the functionality of the brush will not be affected. In some embodiments, the aperture extends from the front 200 of the middle piece 102 and receives a retainer, preventing it from entering the holes.

Any connector described herein that is described as using protrusions and openings may instead use holes and openings having a pin extend through them, as described above.

In some embodiments, the proximate connector 512 may have a female connector piece instead of the illustrated male connector piece, while the left connector 212 of the middle piece 102 may remain female. A device, such as a dowel, may be provided having at least one male connector such that the male connector can be received by the female connector of the proximate connector 512 and the left connector 212. The male connector can include rounded protrusions coupled to the male connector via springs, and/or may include any snap connector, including but not limited to those illustrated in FIGS. 10A-10B. The male connectors may also connect to the female receptors using a tension fit design. For example, the male connector may have a size such that that the tension between the dowel and the female receptors causes the female connectors to be coupled together via the dowel. Any two other pieces 102, 104, 106, 108, 110 of FIG. 1A may be connected in a similar manner (i.e., the connectors of the pieces may be female and be coupled via a dowel or double-ended male connector).

The distal connector 514 may be a snap connector, including but not limited to those illustrated in FIGS. 10A-10B, a spring clip, a button, a pin, screw threading or the like, and in some embodiments is the same as the left connector 212 of the middle piece 102. The distal connector 514 is positioned on the left side 508 of the left side piece 104 and may be adapted to connect the left side piece to the left end piece 108.

In some embodiments, the brush 100 may include two or more left side pieces. In these embodiments, the left side piece 104 can be connected to the middle piece 102 in the manner described above and a second left side piece can be connected to the left side piece 104, such that a proximate connector of the second left side piece is connected to the distal connector 514 of the first left side piece 104. Any number of left side pieces may be coupled together in this manner such that the length of the entire brush is unlimited.

In the embodiment illustrated in FIG. 5, the distal connector 514 includes a rectangular opening 520 and a pair of holes 522 similar to the rectangular opening 224 and pair of holes 226 of the middle piece 102 and may function in a similar manner as the left connector 212 of the middle piece.

Figure 6:
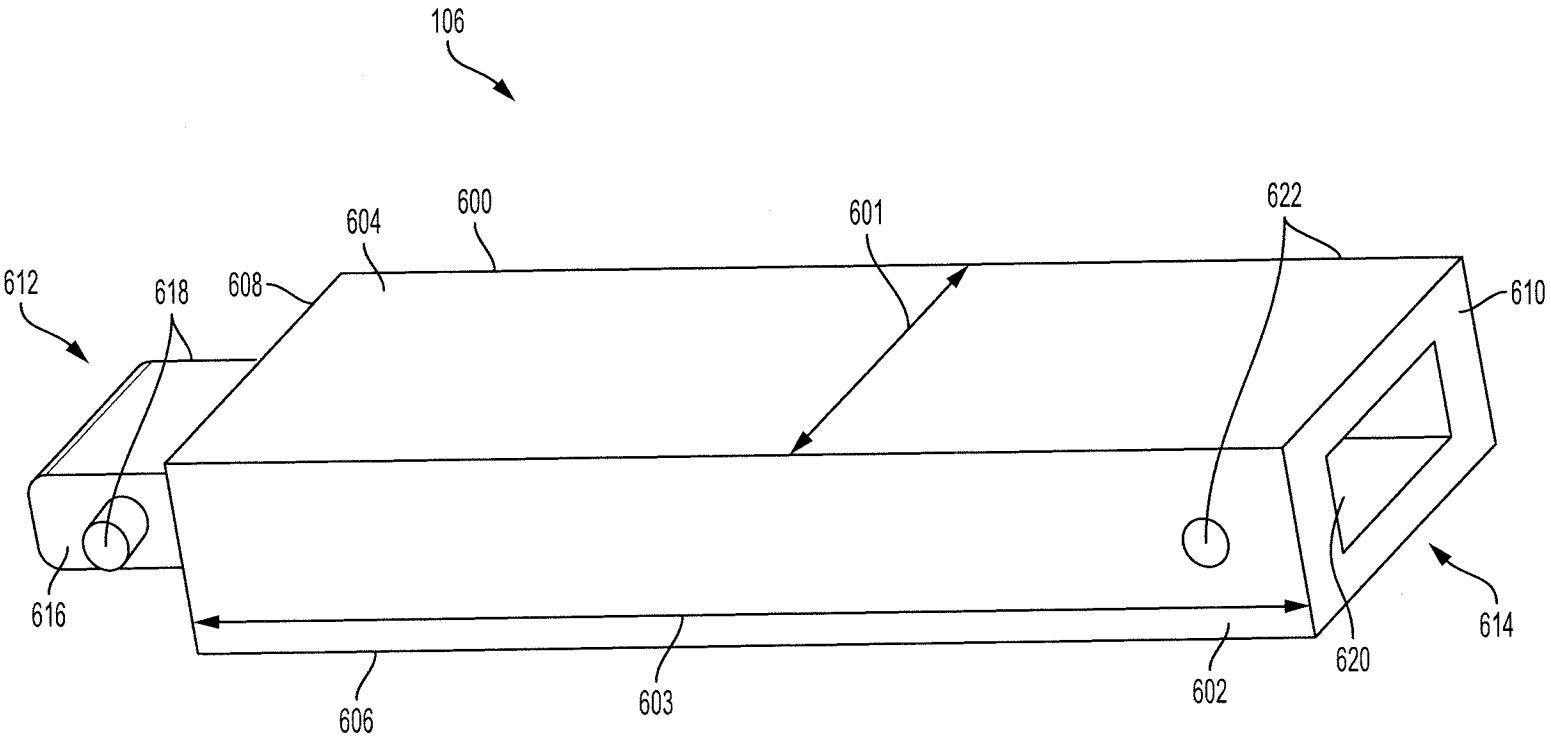
FIG. 6 illustrates a right side piece according to an embodiment of the invention.

FIG. 6 illustrates the right side piece 106. As illustrated, the right side piece 106 has a front 600, a back 602, a top 604, a bottom 606, a left side 608 and a right side 610. The right side piece 106 also includes a proximate connector 612 on the left side 608 and a distal connector 614 on the right side 610.

The right side piece 106 may have a width 601 of any distance. In preferred embodiments, the width 601 is between 1 inch and 10 inches. The right side piece 106 may have a length 603 of any distance. In preferred embodiments, the length 603 is between 4 inches and 10 inches.

The proximate connector 612 may be a snap connector, including but not limited to those illustrated in FIGS. 10A-10B, a spring clip, a button, a pin, screw threading or the like. In the embodiment illustrated in FIG. 6, the proximate connector 612 includes a rectangular member 616 having a round protrusion 618 on either side. In that regard and with brief reference to FIGS. 1, 5 and 6, the proximate connector 612 can operate in the same manner as the proximate connector 512 of the left side piece 104 and can thus be used to connect to the right connector 214 of the middle piece 102 in the same manner as the proximate connector 512 of the left side piece 104 connects to the left connector 212 of the middle piece 102.

Returning reference to FIG. 6, the distal connector 614 may be a snap connector, including but not limited to those illustrated in FIGS. 10A-10B, a spring clip, a button, a pin, screw threading or the like. The distal connector 614 is positioned on the right side 610 of the right side piece 106 and includes a rectangular opening 620 that includes a pair of holes 622. The distal connector 614 may be adapted to connect the right side piece to the right end piece 110 of FIG. 1 and may also be used to attach an additional right side piece to the right side piece 106. In that regard, the number of right side pieces that can be connected together is unlimited.

With reference to FIGS. 5 and 6, the right side piece 106 may be different from the left side piece 104. In some embodiments, the front 500 of the left side piece 104 may resemble the back 502 of the left side piece 104 such that the right side piece 106 and the left side piece 104 have the same design. For example, the left side piece 104 may be rotated 180 degrees and be used as the right side piece 106. This is advantageous as it simplifies the construction of the brush.

Figure 7:
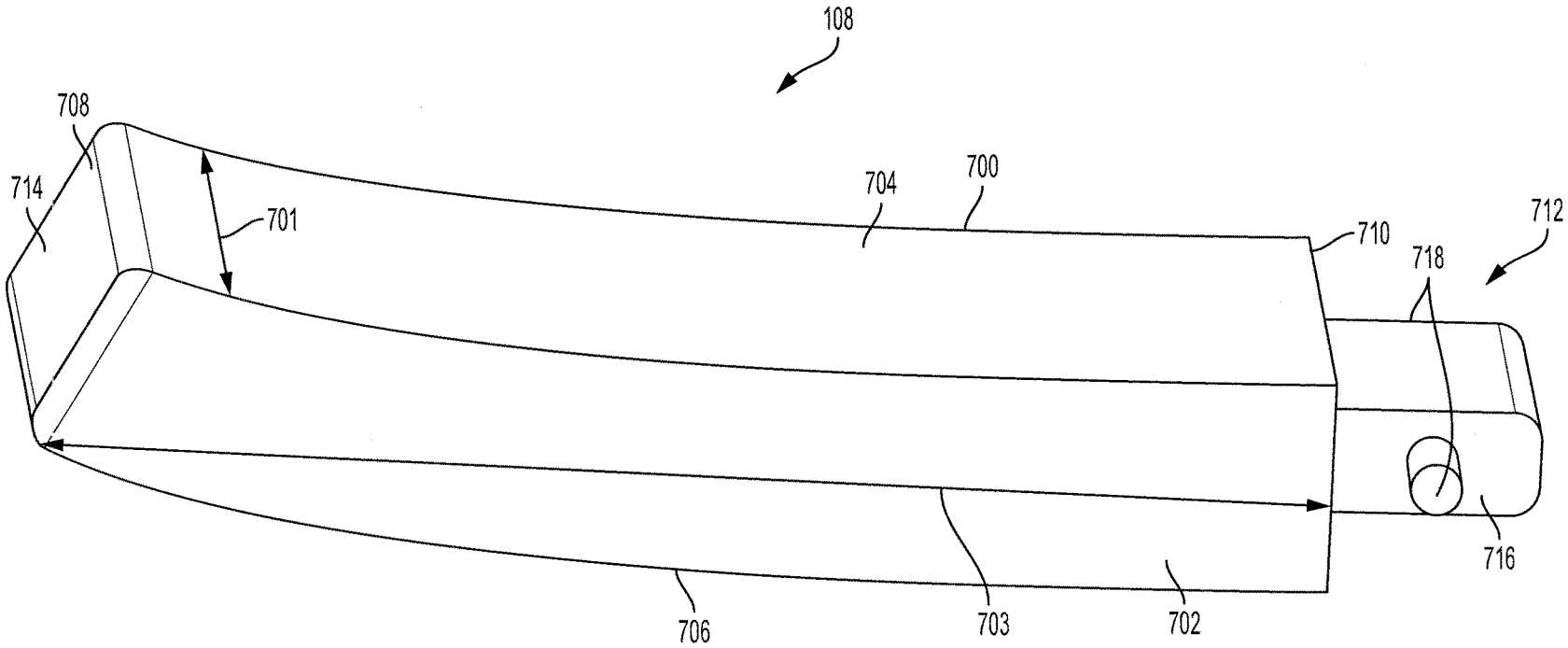
FIG. 7 illustrates a left end piece according to an embodiment of the invention.

FIG. 7 illustrates the left end piece 108. As illustrated, the left end piece 108 has a front 700, a back 702, a top 704, a bottom 706, a left side 708 and a right side 710. The left end piece 108 also includes a proximate connector 712 on the right side 710 and a cap 714 on the left side 708. In some embodiments, the cap 714 is integral to the left end piece 108. In other embodiments, the cap 714 is removably coupled to the left end piece. In some embodiments and with brief reference to FIGS. 5 and 7, a left side piece 104 can be converted to a left end piece 108 by connecting a cap 517 to the distal connector 514 of the left side piece 104. The cap 714 covers or prevents any openings or cavities on the left side 708 of the left end piece 108.

Returning to FIG. 7, the left end piece 108 may have a width 701 of any distance. In preferred embodiments, the width 701 is between 1 inch and 10 inches. The left end piece 108 may have a length 703 of any distance. In preferred embodiments, the length 703 is between 4 inches and 10 inches.

The proximate connector 712 may be a snap connector, including but not limited to those illustrated in FIGS. 10A-10B, a spring clip, a button, a pin, screw threading or the like. As shown in FIG. 7, the proximate connector 712 includes a rectangular member 716 having a rounded protrusion 718 on either side. In that regard, the proximate connector 712 can function in the same manner as the proximate connector 512 of the left side piece 104 of FIG. 5.

The left end piece 108 may be straight along its length 703 or it may be curved upwards along its length 703, as shown. The left end piece 108 may have the same width 701 along the length 703 of the left end piece 108, or the left end piece 108 may taper along the length 703 such that the width 701 is smaller at the left end 708 than at the right end 710.

Figure 8:
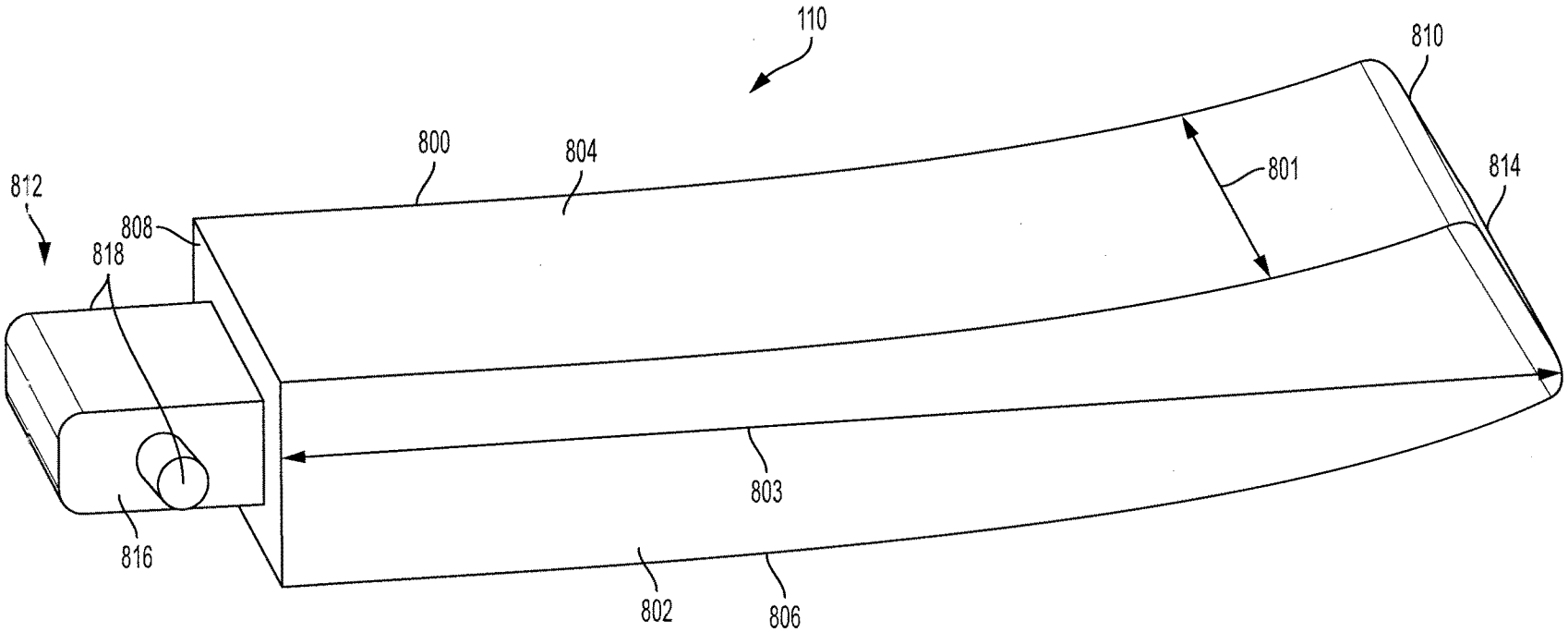
FIG. 8 illustrates a right end piece according to an embodiment of the invention.

FIG. 8 illustrates the right end piece 110. As illustrated, the right end piece 110 has a front 800, a back 802, a top 804, a bottom 806, a left side 808, and a right side 810. The right end piece 110 also includes a proximate connector 812 on the left side 808 and a cap 814 on the right side 810. The cap 814 may be integral to the right end piece 110 or may be removably connected to the right end piece 110. With reference to FIGS. 6 and 8, in some embodiments, a right side piece can be converted to a right end piece 110 by connecting a cap to the distal connector 614 of the right side piece 106.

Returning to FIG. 8, the right end piece 110 may have a width 801 of any distance. In preferred embodiments, the width 801 is between 1 inch and 10 inches. The right end piece 110 may have a length 803 of any distance. In preferred embodiments, the length 803 is between 4 inches and 10 inches.

The proximate connector 812 may be a snap connector, including but not limited to those illustrated in FIGS. 10A-10B, a spring clip, a button, a pin, screw threading or the like. As shown in FIG. 8, the proximate connector 812 includes a rectangular member 816 having a rounded protrusion 818 on either side. In that regard, the proximate connector 812 may function in the same manner as the proximate connector 612 of the right side piece 106 and may connect the right end piece 110 to the right side piece 106 of FIG. 1.

The right end piece 110 may be straight along its length 803 or it may be curved upwards along its length 803, as shown. The right end piece 110 may have the same width 801 along the length 803 of the right end piece 110, or the right end piece 110 may taper along the length 803 such that the width 801 is smaller at the right end 810 than at the left end 808.

With reference to FIGS. 7 and 8, the right end piece 110 may be different from the left end piece 108 or may have the same construction as the left end piece 108 such that the left end piece 108 may be rotated 180 degrees and used as the right end piece 110. This is advantageous as it reduces the quantity of different pieces used to make a brush.

Figure 9A:
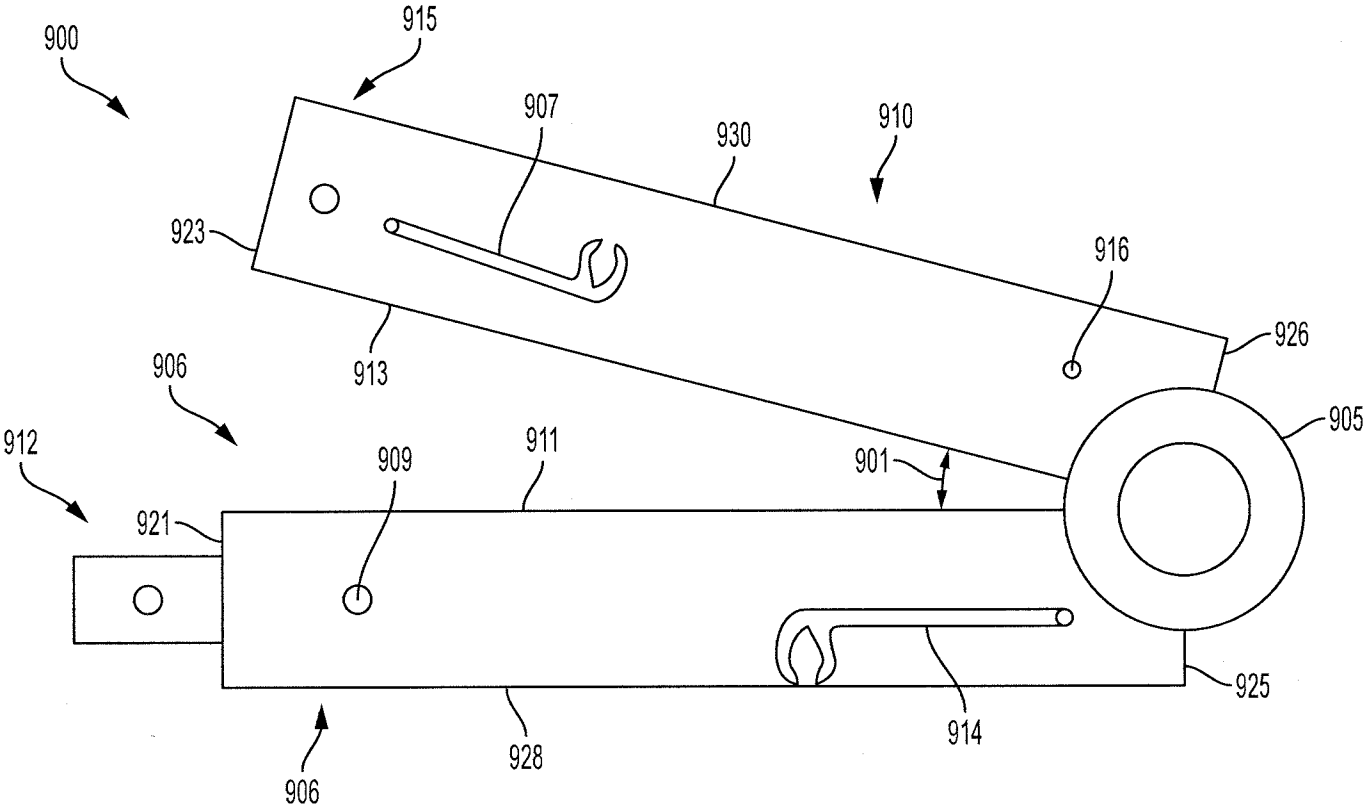
FIG. 9A illustrates a combined right piece having a right middle portion and a right end portion pivotably coupled by a hinge according to an embodiment of the invention.

FIG. 9A illustrates a combined right piece 900 having a right middle portion 906 and a right end portion 910 coupled together via a hinge 905. The hinge 905 may be coupled to a hinge end 925 of the right middle portion 906 and a hinge end 926 of the right end portion 910. The hinge 905 may allow the right middle portion 906 to pivot or rotate relative to the right end portion 910 between 0 degrees and 180 degrees. Due to the range of motion, the combined right piece can be in a closed position (i.e., such that a top 911 of the right middle portion 906 is adjacent to a top 913 of the right end portion 910) or in an open position (i.e., the top 911 of the right middle portion 906 is parallel to the top 913 of the right end portion 910) based on the state of the hinge 905. When in an open position, a bottom 928 of the right middle portion 906 and a bottom 930 of the right end portion 910 are each facing downward, such that bristles attached thereto can be used together to brush a surface.

In that regard, the right end portion 910 includes a latch 907 rotatably coupled to the right end portion 910. The right middle portion 906 includes a cylindrical protrusion 909 extending outward from the right middle portion 906. When the tops 911, 913 are adjacent, the latch 907 can be rotated such that it mates with the cylindrical protrusion 909, coupling the right middle portion 906 and the right end portion 910 together. Accordingly, the right middle portion 906 and the right end portion 910 resist relative movement until sufficient force is applied to the latch 907, removing it from the cylindrical protrusion 909.

The combined right piece 900 may also include a latch 914 rotatably coupled to the right middle portion 906. The right end portion 910 includes a cylindrical protrusion 916 extending away from the right end portion 910. When the tops 911, 913 are parallel (i.e., when the angle 901 is 180 degrees), the latch 914 can be rotated such that it mates with the cylindrical protrusion 916. This causes the right end portion 910 and the right middle portion 906 to resist relative movement until sufficient force is applied to the latch 914 to decouple it from the cylindrical protrusion 916. In some embodiments, other types of connectors such as a strap and button, a slideable lock, or the like may be used to cause the right middle portion 906 and the right end portion 910 to resist separation when the combined right piece 900 is in the open position and/or in the closed position.

Other than the attachment between the right middle portion 906 and the right end portion 910, the right middle portion 906 can have the same features as the right side piece 106 and the right end portion 910 can have the same features as the right end piece 110. For example and with reference to FIGS. 2 and 9A, the combined right piece 900 includes a connector 912 on a proximate end 921 capable of being connected to the middle piece 102. The right end portion 910 can include a connector 915 and/or a cap (not shown) on a distal end 923. In some embodiments, the connector 915 includes the same or similar features as any other connectors described herein. For example, the connector 915 may be adapted to mate with a connector similar to the connector 912 such that multiple combined right pieces can be coupled together. In some embodiments, a cap can be removably coupled to the connector 915. In some embodiments, a cap may be permanently coupled to the distal end 923 of the right end portion 910.

Figure 9B:
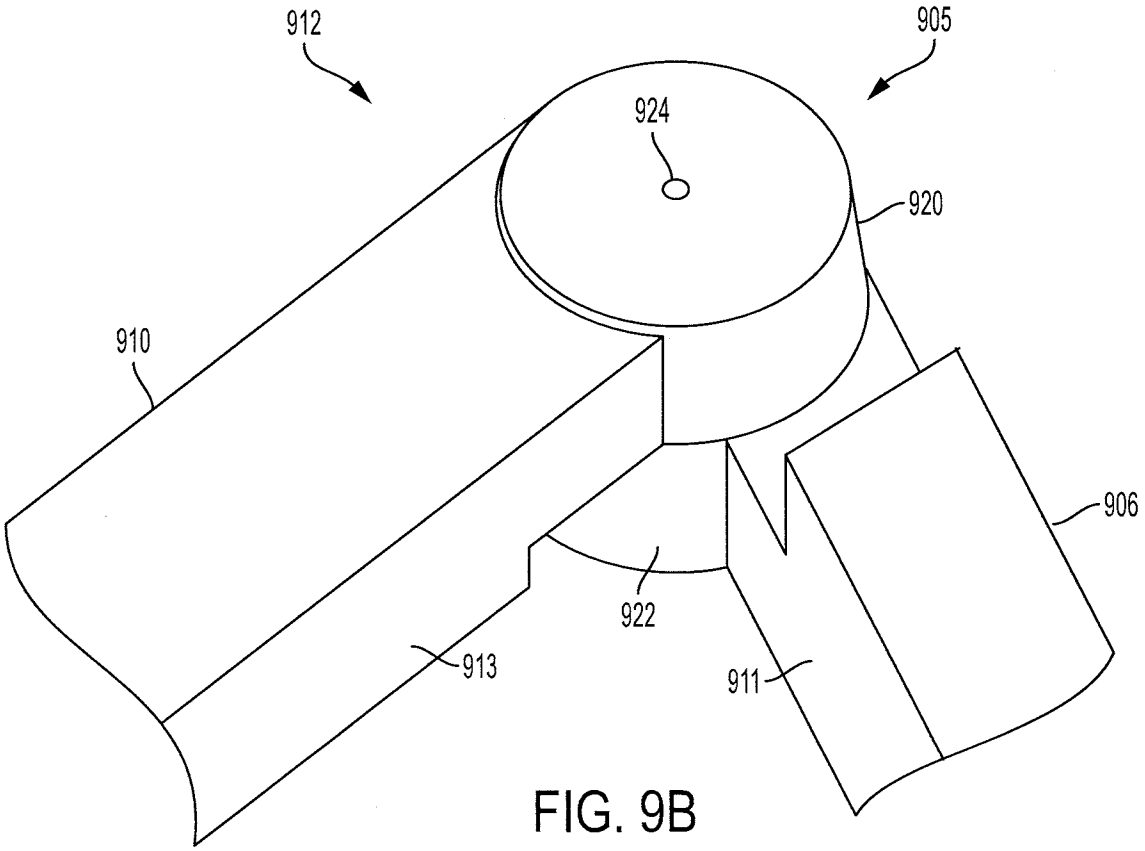
FIG. 9B is an enlarged view of the hinge of FIG. 9A according to an embodiment of the invention.

FIG. 9B illustrates operation of the hinge 905. The hinge 905 can include a first cylinder 920 coupled to the right end portion 910 and a second cylinder 922 coupled to the right middle portion 906. The first cylinder 920 and second cylinder 922 can be coupled together, for example, by a pin 924 at a pivot point. The first cylinder 920 and the second cylinder 922 (and thus the right middle portion 906 and the right end portion 910) can pivot or rotate relative to each other about the pin 924.

A combined left piece (not shown) can also be provided having similar features as the combined right piece 900. In some embodiments, a combined left piece can be a mirror image of the combined right piece 900, and in some embodiments, two combined pieces having the same shape and design can be provided, one used as a combined left piece and one as a combined right piece. Thus, an adaptable brush can include the middle piece 102, the combined right piece 900, and a combined left piece.

FIGS. 10A and 10B illustrate various snap connectors and features thereof. A snap connector can refer to any of the illustrated snap connectors or any other removable connector that can "snap" together and/or apart. In some embodiments, a snap connector can refer to a connector that can be connected or disconnected in a relatively short amount of time by an average male (such as within 30 seconds).

FIGS. 10B and 10C illustrate an exemplary snap connector 1001 that can be used as a proximate connector 1012 of a left end piece 1018 and a distal connector 1014 of a left side piece 1016. The snap connector 1001 can be used as any connector or connectors of any of the pieces disclosed herein.

The proximate connector 1012 defines a plurality of slots 1006 including a slot 1006*a* and a slot 1006*b*. The slots may have at least a larger diameter portion 1008 and a smaller diameter portion 1010. The distal connector 1014 can include a plurality of protrusions 1000 including a protrusion 1000*a* and a protrusion 1000*b*. The protrusions 1000 can include a head 1002 and a neck 1004 having a smaller diameter than the head 1002.

In order to couple the left side piece 1016 to the left end piece 1018, the head 1002 may be inserted through the larger diameter portion 1008 of the corresponding slot 1006. When the head 1002 has extended past the slot 1006, the neck 1004 may be aligned with the slot 1006. At this point, the neck 1004 may be moved towards the smaller diameter portion 1010. As the head 1002 has a larger diameter than the smaller diameter portion 1010, the left side piece 1016 is coupled to the left end piece 1018.

With reference to FIGS. 1A and 1B, the modularity of the brush 100 described herein provides several advantages over traditional brushes. One advantage is a decrease in the cost of shipping of the brush 100 relative to another brush having a similar total length. The cost of shipping an item increases as the required area for shipping increases. Because the brush 100 can be disassembled into separate pieces, packaging will require less space, thus reducing the shipping cost.

As another benefit, replacement costs for the brush 100 will be lower because a single piece can be replaced instead of the entire brush 100. For example, if the left end piece 108 breaks, the entire brush 100 can be fixed by replacing the broken left end piece 108 only.

As disclosed above, different bristles 112 may be preferable for various situations. Another advantage of the brush 100 is that it can be adapted to use various bristles by either using different sets of pieces having different bristles 112 (for example, one set having metal bristles and another having nylon bristles), or by using different sets of bristle attachments 114, 116, 118, such that each set of bristle attachments 114, 116, 118 has different bristles 112.

Yet another advantage of the brush 100 described herein is that the size of the brush can be adjusted. For example, it is preferable to use a larger brush when cleaning a large open area, but it is preferable to use a smaller brush if many obstacles exist in the area to be cleaned. Because the pieces are all removably connectable, a brush 100 of any size can be created.

Exemplary embodiments of the methods/systems have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A brush comprising:

a middle piece having a left side and a right side and including a pole connector adapted to connect to a pole, a left connector positioned on the left side of the middle piece, and a right connector positioned on the right side of the middle piece;

a combined left piece including:

a left middle portion having a proximate end, a hinge end, and a connector coupled to the proximate end and configured to be removably coupled to the left connector of the middle piece, a left end portion having a distal end and a hinge end pivotably coupled to the hinge end of the left middle portion, a left protrusion located on the left middle portion or the left end portion; and a left latch rotatably coupled to the other of the left middle portion or the left end portion and configured to interface with the left protrusion via rotation of the left latch when the left end portion is rotated away from the left middle portion in an open position in order to resist rotation of the left end portion relative to the left middle portion; and a combined right piece including:

a right middle portion having a proximate end, a hinge end, and a connector coupled to the proximate end and configured to be removably coupled to the right connector of the middle piece, a right end portion having a distal end and a hinge end pivotably coupled to the hinge end of the right middle portion, a right protrusion located on the right middle portion or the right end portion; and a right latch rotatably coupled to the other of the right middle portion or the right end portion and configured to interface with the right protrusion via rotation of the right latch when the right end portion is rotated away from the right middle portion in the open position in order to resist rotation of the right end portion relative to the right middle portion.

2. The brush of claim 1 wherein the combined left piece is substantially identical to the combined right end piece.

3. The brush of claim 1 wherein the right middle portion and the right end portion each have a top and are coupled together by a hinge configured to allow the right middle portion and the right end portion to rotate relative to each other to cause the combined right piece to change between a closed position in which the top of the right end portion is adjacent the top of the right middle portion and the open position in which the top of the right end portion is parallel to the top of the right middle portion, and the left middle portion and the left end portion each have a top and are coupled together by a hinge configured to allow the left middle portion and the left end portion to rotate relative to each other to cause the combined left piece to change between a closed position in which the top of the left end portion is adjacent the top of the left middle portion and the open position in which the top of the left end portion is parallel to the top of the left middle portion.

4. The brush of claim 3 further comprising:

a secondary left protrusion located on the left middle portion or the left end portion;

a secondary left latch located on the other of the left middle portion or the left end portion and configured to interface with the secondary left protrusion when the combined left piece is in the closed position in order to resist rotation of the left end portion relative to the left middle portion;

a secondary right protrusion located on the right middle portion or the right end portion; and a secondary right latch located on the other of the right middle portion or the right end portion and configured to interface with the secondary right protrusion when the combined right piece is in the closed position in order to resist rotation of the right end portion relative to the right middle portion.

5. The brush of claim 3 wherein the hinge includes a first cylinder coupled to the right middle portion and a second cylinder coupled to the right end portion and pivotably coupled to the first cylinder via a pin such that the first cylinder or the second cylinder can rotate relative to the other of the first cylinder or the second cylinder about the pin.

6. The brush of claim 1 wherein:

the middle piece and the left middle portion of the combined left piece each have a longitudinal axis, one of the left connector of the middle piece or the connector of the left middle portion of the combined left piece defines an opening perpendicular to the longitudinal axis of the corresponding piece and defines a pair of apertures adjacent and perpendicular to the opening, and the other of the left connector of the middle piece or the connector of the left middle portion of the combined left piece includes a member extending away from and parallel to the longitudinal axis of the corresponding piece, having a protrusion on either side, and configured to mate with the opening such that when mated, the member is positioned within the opening and each of the protrusions is positioned in an aperture of the pair of apertures.

7. The brush of claim 6 wherein the member and the opening are each rectangular and the pair of apertures and the protrusions are each rounded.

8. The brush of claim 1 wherein the left connector of the middle piece and the connector of the left middle portion of the combined left piece include at least one of a snap connector, a spring clip, a button, or screw threading.

9. The brush of claim 1 wherein the middle piece has a longitudinal axis and the pole connector defines an opening perpendicular to the longitudinal axis and a pair of apertures adjacent and perpendicular to the opening, wherein the opening is configured to receive a member having a protrusion on either side such that when the member is connected to the pole connector, each of the protrusions extends into an aperture of the pair of apertures.

* * * * *